United States Patent [19]

Warshaw et al.

[11] 4,061,526

[45] Dec. 6, 1977

[54] CARTON SEALING MACHINE HAVING RELEASABLE LATCHING MEANS TO HOLD RETRACTED TAPE APPLYING MEANS WHILE ANY CARTON TRAVELS THEREPAST

[75] Inventors: Saul Warshaw, Hawley, Pa.; Winton Loveland, Fort Salonga, N.Y.; Horst J. Hanemann, Manhasset, N.Y.; Michael Ramaglia, East Patchogue, N.Y.

[73] Assignee: The Loveshaw Corporation, Deer Park, N.Y.

[21] Appl. No.: 704,767

[22] Filed: July 13, 1976

[51] Int. Cl.[2] ..... B32B 31/00

[52] U.S. Cl. ..... 156/468; 156/486; 156/522; 156/530

[58] Field of Search ..... 156/522, 468, 486, 477 R, 156/475, 530

[56] References Cited

U.S. PATENT DOCUMENTS 3,954,550 5/1976 Patterson ..... 156/486

FOREIGN PATENT DOCUMENTS 848,091 9/1960 United Kingdom ..... 156/468

*Primary Examiner*—David A. Simmons

*Attorney, Agent, or Firm*—Watson, Leavenworth, Kelton & Taggart

[57] ABSTRACT

In a machine for sealing forwardly traveling cartons with adhering tape lapping folded stacked flaps as top and/or bottom closure means to prevent normally projecting tape applicator means from applying to such closure means of each carton excessive inward pressure which may cause such deflection thereof as to catch into and break back out an edge portion of the carton back end wall. Movable mounted tape applicator means is projectable into a defined path of forward travel of a folded stacked flap closure of an advancing carton for depression by the latter as it travels forwad thereover for application of tape to such forwadly traveling closure. Mechanism that is alternately projectable and depressible of the tape applicator means is located initially in the path of forward travel of each such carton for depressive manipulation of this projecting applicator means upon contact by the advancing carton. Releasable latch means which is manipulated by that mechanism is provided to hold the tape applicator means depressed while the advancing carton and its closure are traveling past the tape applicator means. There is also provided means to release the latch means for restoring the projection of the tape applicator means into the carton travel path after passage of this carton.

11 Claims, 8 Drawing Figures

CARTON SEALING MACHINE HAVING RELEASABLE LATCHING MEANS TO HOLD RETRACTED TAPE APPLYING MEANS WHILE ANY CARTON TRAVELS THEREPAST

BACKGROUND AND SUMMARY

The present invention is concerned with a machine, and the mechanism thereof, for applying adhering tape, such as pressure sensitive tape, to cartons having their end and side flaps on the tops and bottoms thereof folded inward, so as to anchor those folded flaps securely, such as is taught in the copending U.S. patent application of Saul Warshaw, Winton Loveland, and Horst J. Hanemann, Ser. No. 645,718, filed Dec. 31, 1975, the disclosure of which is embodied herein by reference.

As is therein indicated it is an old practice in the concerned art to provide such machines which receive from an operator's hands or equipment he controls cartons with their top and bottom flaps folded over contained contents, and to apply to each carton pressure sensitive tape for securely anchoring in closed positions the folded carton flaps. These machines are equipped with tape applying assembly units each of which frequently has two tape applicator rollers that are pivotally mounted for swing. In some such machines this tape applying unit has a single first roller projecting into a path of transport of each carton through the machine and with this roller supporting an end of the tape with its adhesively coated face opposed to the leading end wall of the on-coming carton for adherence anchorage thereto. Then, as the carton advances, it swings this first applicator roller forward to lower it out of the way of this oncoming carton while wiping the adhesive tape to anchorage of carton surfaces, i.e., first a portion of the carton leading end wall surface, then along the longitudinal top (or bottom as the case may be) to lap the opposed edges of the infolded side flaps and finally to leave a trailing end section to lap up (or down as the case may be) against the trailing carton end wall by the second, or one of the remaining pair of applicator rollers when there are three thereof. This second roller constitutes with its carrying arm means a sub-assembly which is pivoted to supporting frame structure of the mechanism and the carrying arm means of this roller which follows the first roller is linked by a coupling means to the carrying arm means of this first roller, so that as the latter is depressed by advance of the carton for wiping of the tape thereby longitudinally along the carton, the swing of the first roller's carrying arm means forward swings back the carrying arm means of the second roller to cause the latter to repeat the wipe against the tape laid down longitudinally until the carton back wall is reached. This piece of tape is severed, e.g., cut off by a knife pivotally supported with the pivotal support of the first roller carrying arm means, and the resultant trailing free end of the tape is then wiped over the carton trailing back corner and against the carton back end wall to complete the tape application operation with respect to our stacked flap closure.

The projection of such applicator means, such as rollers supported by pivoted carrying arm means, into the path through the machine of the successive loaded cartons for application to their stacked flaps closures of lengths of the sealing tape is effected by suitable mechanisms of the tape applying assembly units which project the tape applicator means, e.g., the rollers, into the carton travel path. This may be accomplished by biasing means therein to which depressing force may be employed for depression or retraction of such rollers and their movable supports to the vicinity of the margins of the forward travel path of such carton and its closures of folded flaps by suitable means. Further, it may be desired that as either or both of the top and bottom stacked flaps closures of each carton are moving past the urged or biased tape applicator means during the carton forward travel the tape applicator means perform their required functions of pressing the adhering tape to such flaps closures while limiting the pressing urgency to, at most, a minor distance inward of the plane of such closure. This is to avoid a problem of such tape applicator means being urged inward to such a depth of deflection or distortion of such advancing flaps closures as to be likely to cause the applicator means, e.g., the roller, to catch into and break back out an edge portion of each such following carton end wall. This likelihood of carton back wall damage is more apt to occur when either the carton load is fluid or light and fluffy, or when there is an empty head space in the carton due to the load being insufficient snugly to fill the carton chamber.

It is an object of the present invention to reduce materially or eliminate reliably and economically in a relatively easy manner the development of such problems and attendant carton damage.

The present invention accomplishes this desired result by embodying in the tape applying assembly which is mounted either in the machine base or the elevating head beam thereof, or both, if desired, mechanism alternately to project and depress such tape applicator means located initially in the path of forward travel of each such carton for depressive manipulation thereof upon contact by the advancing carton. Releasable latch means are provided in such assembly which is manipulated by this mechanism to hold the tape applicator means depressed while the advancing carton and its closure are traveling past the tape applicator means. Also there are provided therein means to release this latch means for restoring the projection of the tape applicator means into the carton travel path for like operation with respect to the following advancing carton after passage of this preceding carton.

The releasable latch means, which is manipulated by the mechanism for alternately projecting and depressing the tape applicator means, desirably and conveniently is in the form of two separate such latch means with each individually manipulated by carton-depressible control means. Preferably such control means are in the form of a pair of individual pivoted levers. Each of a pair of catches with each engagable by a complementary latch hook in each of the pair of latch means is carried individually by one of these levers. The one of this pair of levers which is first engaged and depressed by the advancing carton carries the catch of the first latch means and the latch hook of the latter conveniently is manipulated by a projecting, carton-depressible trigger. The catch of the second latch means conveniently is carried by the carrier lever which supports the second roller and the complementary latch hook thereof that cooperates with this second catch conveniently is manipulated by the first lever which carries the first catch. For further convenience this first lever is also employed to support and carry with it in its up and down swing a knife that is swung up thereby as the advancing carton moves forward therebeyond, so as to cross the tape supply path as the tape extends back to adherence of a stack of flaps closure of the carton for cutting off this adhering piece of tape.

The latch hook of the first latch means is manipulated to a disengage position relative to its complementary catch carried on the knife carrier lever by thrust means connected to the trigger which preferably is an up and down swinging trigger member. The latch hook of the second latch means is manipulated to its disengage position relative to its complementary catch mounted on the second roller carrier lever by thrust means connected to the knife carrier lever.

Thus it is a further object of the invention conveniently to utilize for a plurality of additional latching purposes members of such a two applicator rollers tape applying assembly which otherwise may be largely conventional except for such roller-retraction latching service and the swinging cut-off knife.

Other objects of the invention will in part be obvious and will in part appear from reference to the following detailed description taken in connection with the accompanying drawings, wherein like numerals identify similar parts throughout, and in which.

Figure 6:
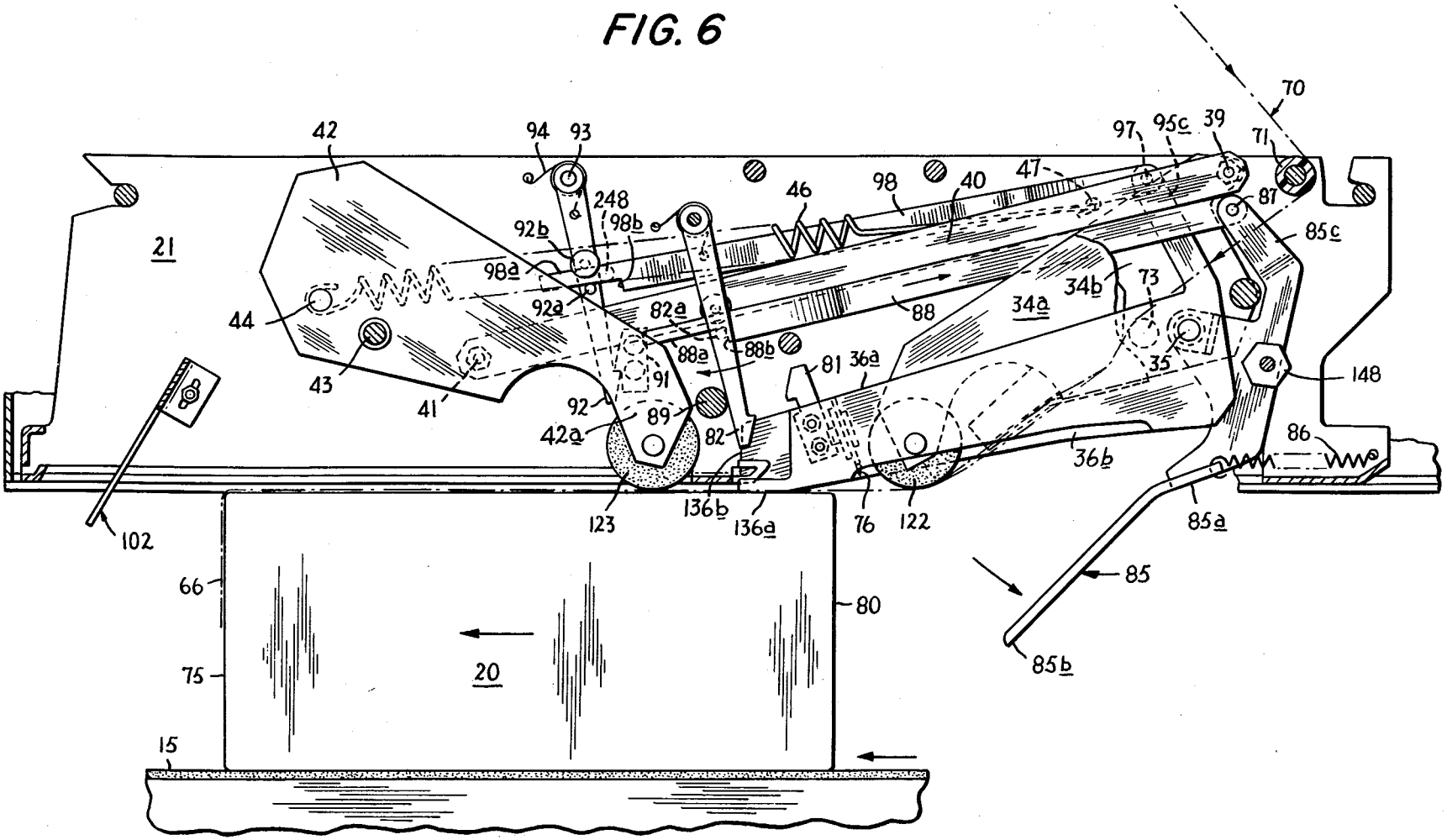
FIG. 6 is a sectional view, with parts broken away, of the structure shown in and similar to FIG. 5, indicating further advance of the loaded carton to a position freeing some of the tape applying assembly parts.
Figure 7:
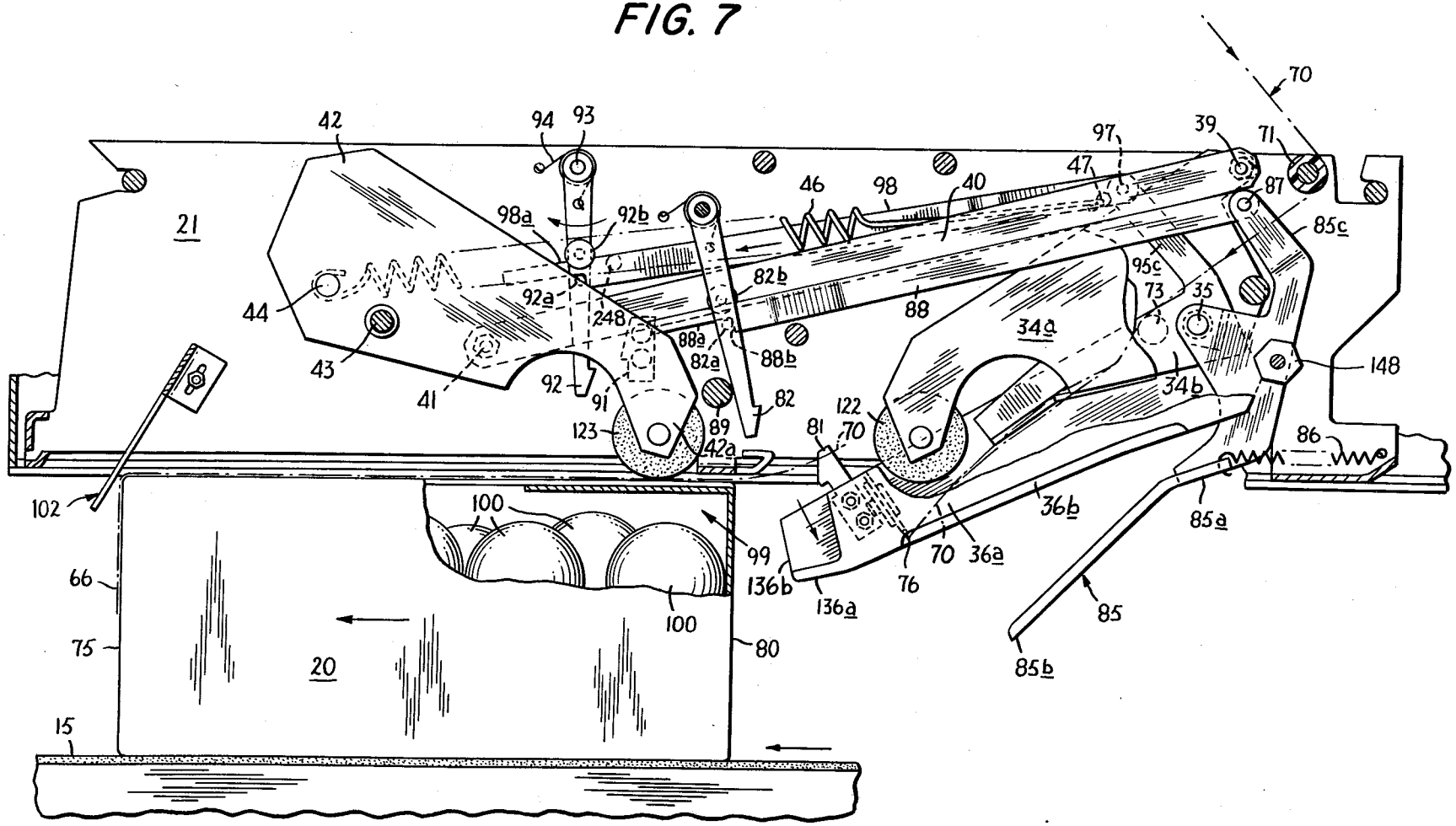
Figure 8:
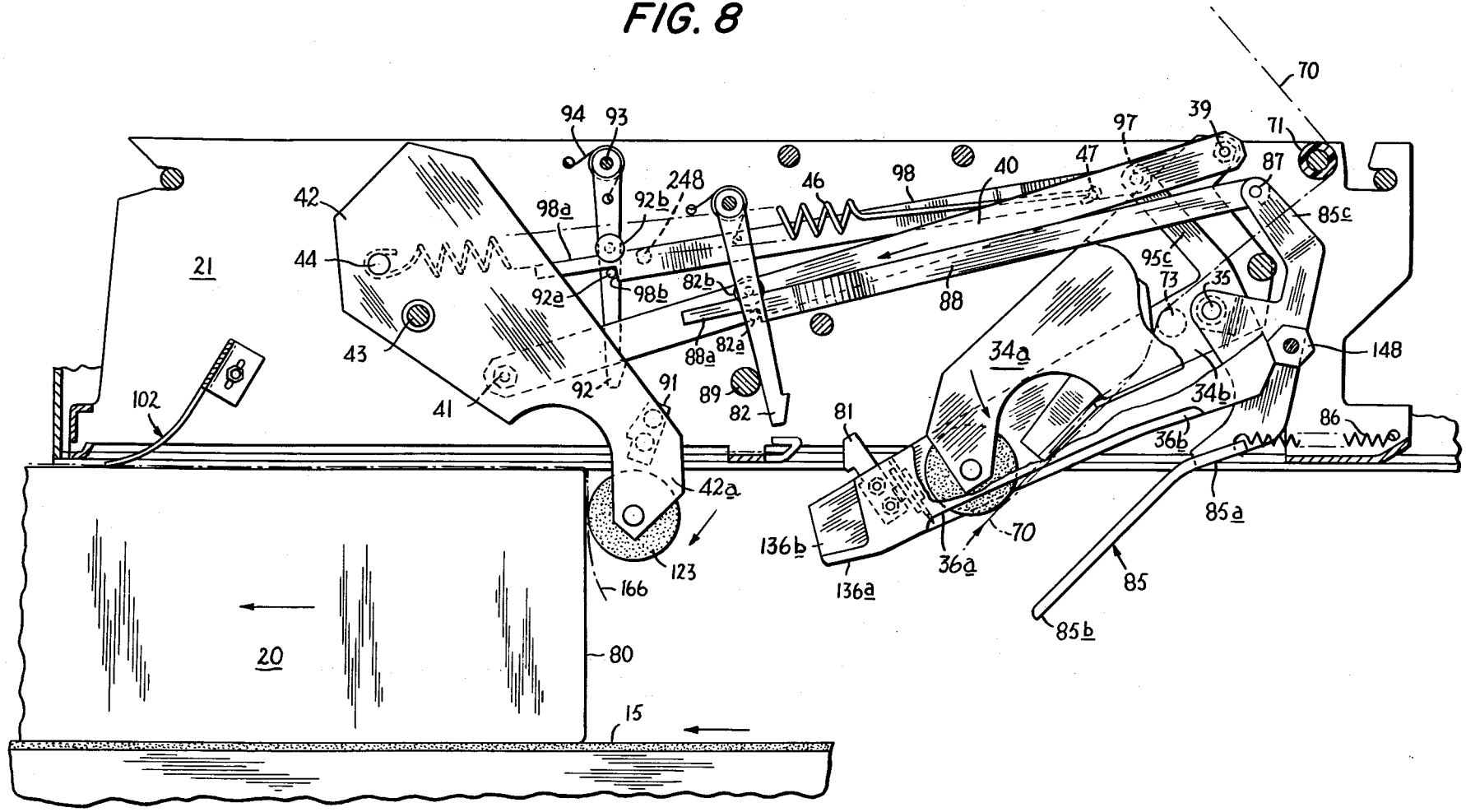

FIG. 7 is a view similar to FIG. 6, with parts broken away and in section, indicating a portion of the sidewall of the carton broken out to illustrate empty head room therein which could have, except for the practice of the present invention, led to destruction of the carton back end wall; and FIG. 8 is a view similar to FIG. 7, with parts broken away and in section, showing still further advance of the carton as it is being transported beyond the tape applying assembly mechanism for projection of parts thereof again into the carton advancing path.

Figure 1:
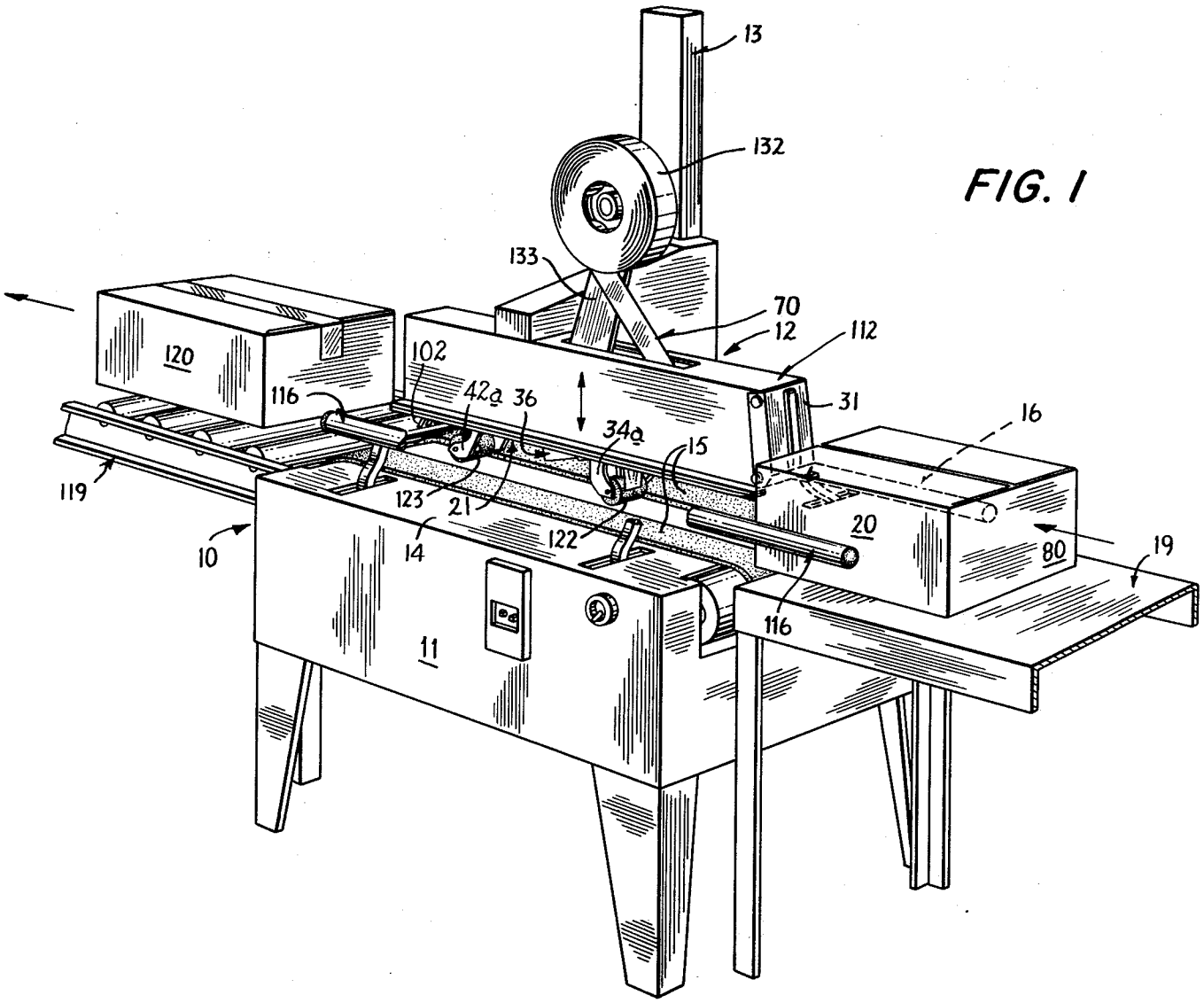
FIG. 1 is a perspective view of a carton taping machine, with parts broken away and in section, which is equipped with a tape applying mechanism unit of the present invention that is embodied in its elevating head thereof.

The carton sealing machine which embodies the tape applying mechanism that includes the present invention is illustrated at 10 in FIG. 1, having a lateral base structure 11 suitably equipped with transport belts 15 for advancing loaded cartons laterally along the top of the base structure successively, as illustrated at 20 and 120, beneath a lowered elevator head beam structure 12 with the latter supported, for slidable up-and-down movement, on a vertical column 13 that is mounted on the back side of the base structure.

The base structure 11 is provided with a relatively horizontal top panel 14 over which are driven the top runs of a pair of transversely-spaced, endless, carton-transporting belts 15. Above the base top panel 14 is supported a pair of longitudinally-extending and transversely-spaced, carton-snugging side rails, indicated at 16 and 116, suitably supported by transversely-moving arm structure alternatively and simultaneously to move the side rails toward and away from each other.

The entrance end of the base structure may be preceded by a suitable roller table 19 on which an attendant may rest an empty carton with its bottom end flaps and side flaps folded inwardly for defining a folded stacked flaps closure and, after loading the carton chamber, then infolding the top end and side flaps for providing a folded stacked flaps closure longitudinally along the top thereof. The tape applicator assembly 21 has been mounted in the head beam 112 for the purpose of applying a strip of adhering tape over this folded stacked flap top closure of the carton.

The tape applicator assembly or applying mechanism is in the form of a unitary cartridge 21 which is readily mounted up into and demountable down out of a slot in the bottom of this head beam 112. In such mounted position of the tape applicator assembly 21 within the head beam a first tape applying roller 122 is supported in a position of projection down into the path of advance of the carton 20, and succeeding cartons therefollowing, by its support arms which are paired at opposite ends of this roller with the near one referenced **34*a*, and the far one illustrated in other figures and referenced 34*b*. A second, farther forward, tape applying roller 123 is shown projecting in similar fashion down out of the bottom of the tape applying assembly 21 also into the carton advance path by similar, but reversed, arms 42*a* and 42*b*. The paired arm structure 34*a* and 34*b* which supports the first tape applying roller 122 is pivotally mounted about a cross shaft 35, and a similar cross shaft 43 pivotally supports the second roller support arms 42*a* and 42*b*. Above the pivot point at 35 of the roller arms 34*a* and 34*b* an extension 38 of this pivoting arm structure has pivotally mounted thereto at 39 a connecting rod or bar 40 which in turn is pivotally connected to the second roller supporting arms structure 42*a* and 42*b* at 41 below the pivot point at 43. Thus the first roller support arms 34*a* and 34*b* are in the form of a lever of the first class and the second roller support arms 42*a* and 42*b*** are in the form of a lever of the third class.

The power circuitry which operates the various mechanisms of the carton taping machine 10 preferably is of the pneumatic type as is fully explained in the parent U.S. application Ser. No. 645,718, identified above. A control in such pneumatic circuitry on the approach end of the head beam 112 will be abutted by the leading end wall of the loaded closed carton as the operator pushes it forward to between the side guide rails 16 and the companion one which is not shown in FIG. 2. As the loaded carton 20 enters the machine to be received upon for transport forward by the endless belts 15 the elevation of the head beam 112 is pneumatically adjusted so that its substantially flat bottom structure will rest upon the lateral carton top, including its infolded side flaps having their free edges in closely opposed relation for lap by the adhering tape which is to be lapped thereover in the advance of the carton through the machine. Such tape 70 is fed by being drafted from a supply roll 132 supported upon the head beam by a bracket 133. This tape is then drafted forward successively over and against guide rollers 71, 72 and 73 for feed to the tape guide mechanism 55 for supply thereof to the first applicator roller 122 over which it is to be lapped.

Figure 4:
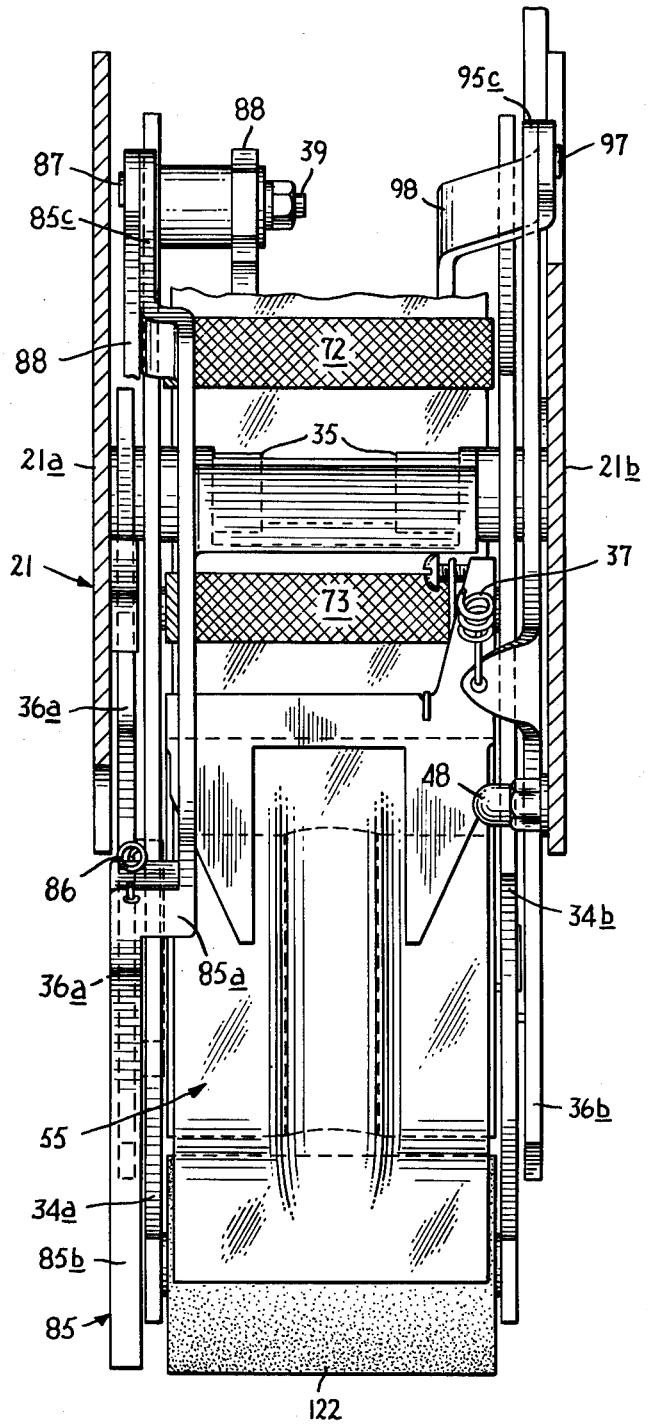
FIG. 4 is a sectional view to larger scale, with parts broken away, taken substantially on line 4—4 of FIG. 2.

As will be seen from FIGS. 1 and 4, transversely-spaced pivoted arms 34*a* and 34*b*, which rotatably carry therebetween the applicator roller 122, and which are rotatably supported by the transverse axle shaft 35, are spring-biased to an upright projecting position by a tension spring 46 which is anchored at one end to the top end 42 of the second roller supporting arm structure 42*a* and 42*b* at a point of anchorage at cross pin or rod 44 and with its other end anchored at 47 to the coupling link or bar 40. This upright projecting position of the first roller 122 is assured by abutment of its swinging support arm 34*a* against the first abutment stop pin or knob 48.

A first lever structure is constituted by the pair of arms 36*a* and 36*b* which are pivotally mounted about the axle shaft 35 on which the first roller support arms are swingably mounted. This lever arm structure 36*a* and 36*b* is employed to support the transverse knife 76 which is to be swung downwardly for severance of the tape at a proper length for serving as the folded side flaps anchorage to the carton back end wall. This knife carrying arm structure 35*a* and 36*b* is biased to the projecting position in FIG. 1 by tension spring 37. This knife-carrying arm structure 36*a* and 36*b* is limited in its swing outward to the projecting position shown in FIG. 1, into the path of advance of each carton, by means of a fixed stop 148 and such outward swing is induced by the tension spring 37.

While one stop lug or abutment may be employed to serve as outward swing limiting stop means for both the roller carrying arms 34*a* and 34*b*, and the knife carrying arms 36*a* and 36*b*, such as that at 48, it is more convenient and less demanding of careful adjustment thereof relative to those swinging arm assemblies to provide a separate one for each. Thus stop 48 is provided to serve for limiting swing of the arm assembly carrying roller 122 and stop 148 for limiting swing of the arm assembly carrying the knife 76.

A first latching means of the present invention includes a catch 81 mounted on the knife-carrying side arm 36*a* for cooperative engagement by a swinging latch hook 82 pivotally mounted in the mechanism assembly frame 21 by a stub shaft 83 and biased counterclockwise by a coil spring 84 for engagement with the catch 81. For cooperation therewith a pivoted trigger member 85 is provided which is also rotatably mounted on the cross shaft 35, with this trigger member being provided with a lateral offset 85*a* to cross over from a point inward of the lever member 36*a* toward the outer side thereof (FIG. 4) for spanning the first roller arm 34*a* and so that its operative extension 85*b* is substantially aligned with the knife-carrying lever arm 36*a*, all as will be best understood from FIGS. 1, 4 and 5. The pivoted trigger member 85 is biased in a counterclockwise direction by a tension spring 86, and an arm 85*c* thereof extends upwardly to pivoted connection at 87 with a thrust rod 88 which has an elongated tongue extension of reduced width 88*a* riding alongside of the pivoted latch hook 82 between a pin 82*a* and a button headed guide 82*b* for slide therebetween to permit a notch shoulder 88*b* on the thrust bar 88 to engage this upper pin 82*a* for forcing the latch hook 81 to swing counterclockwise or forward for disengagement with its catch 81, so as to free the spring-biased knife-carrying trigger member 85 for swing downward of the nose section 85*b* of the latter into the path of the next oncoming loaded carton. A knob or pin stop 89 is mounted on the near sidewall of the frame of the tape applicator assembly unit 21, in the path of counterclockwise swing of the latch hook 82 to limit that rotary forward motion thereof, so as to avoid interference with adjacent moving members and to prevent disengagement of the reduced width tongue extension 88*a* of the thrust rod 88 between the guide pin 82*a* and the button headed guide 82*b*.

In a similar fashion the second roller pivoted support arm 42*b* carries a catch 91 for cooperative engagement with a second pivoted latch hook 92 which is pivotally supported on a pin 93 and biased in a counterclockwise direction toward the entrance end of the machine by a spiral spring 94. This is a utilization of the pivoted arms structure 42 for a latching lever purpose apart from its function of supporting the second tape applying roller 123. The first lever means comprising the pivoted arms 36*a* and 36*b* which carry the knife 76 for swing upward and clockwise about the pivoting cross axle 35 also carries an extension arm 95*c* pivotally mounted at 97 to a second thrust rod or bar 98. The thrust bar 98, like the thrust bar 88 also has a reduced width tongue extension 98*a* which rides between an outer guide pin 92*a* and a button headed guide 92*b* for a like purpose as explained in connection with the thrust bar 88, i.e., so that a shoulder 98*b* formed thereon will thrust against the guide pin 92*a* for swing of this latch hook 92 forward or counterclockwise to disengage it from catch 91.

The latching mechanisms of the present invention advantageously impose the following operations upon the subassemblies of the tape applying machine as described herein and shown in the drawings. Let it be assumed that a carton 20 has been provided with its load which may not completely fill the chamber thereof so as to leave a head space therein, with the bottom end flaps and side flaps infolded to provide a stack of flaps bottom closure, and the top end flaps and side flaps folded inward and downward to provide a top flaps stack closure. Such carton will be fed by the operator to the entrance end of the machine base between the side guide rails 16 and 116 with the head beam 112 automatically adjusted downward to rest upon the top of the advancing carton. In such advance the leading end wall 75 of the loaded carton 20 will, in its advance, abut the tape applying roller 122 to apply a tape end section 66 to such carton leading end wall. The advancing travel of the carton will cause its leading end wall to press forward against this tape applying roller 122, so as to swing its support arms 34*a* and 34*b* forward with gradual retraction of this roller from the carton path, so as to wipe the self adhering tape up against this leading end wall 75 to the top corner thereof as this roller is retracted so as to travel along the carton top. Upon such clockwise swing of this tape applying roller 122 and its supporting arms about the pivot axis 35 the base ends of these arms at 38 swing rearward to apply pull to the connecting link or bar 40 through the pivot point 39 thereof so that at the other pivot point 41 thereof pull is applied to swing the arms 42*a* and 42*b* counterclockwise to move the second tape applying roller 123 rearward to the position indicated in FIG. 5. By this action this tape applying roller 123 is caused to move upward along the leading end wall 75 of the carton 20 so as to travel over the top edge of this end wall and then travel along toward the carton back end wall 80 as this carton is moved forward by the transport belts.

Figure 5:
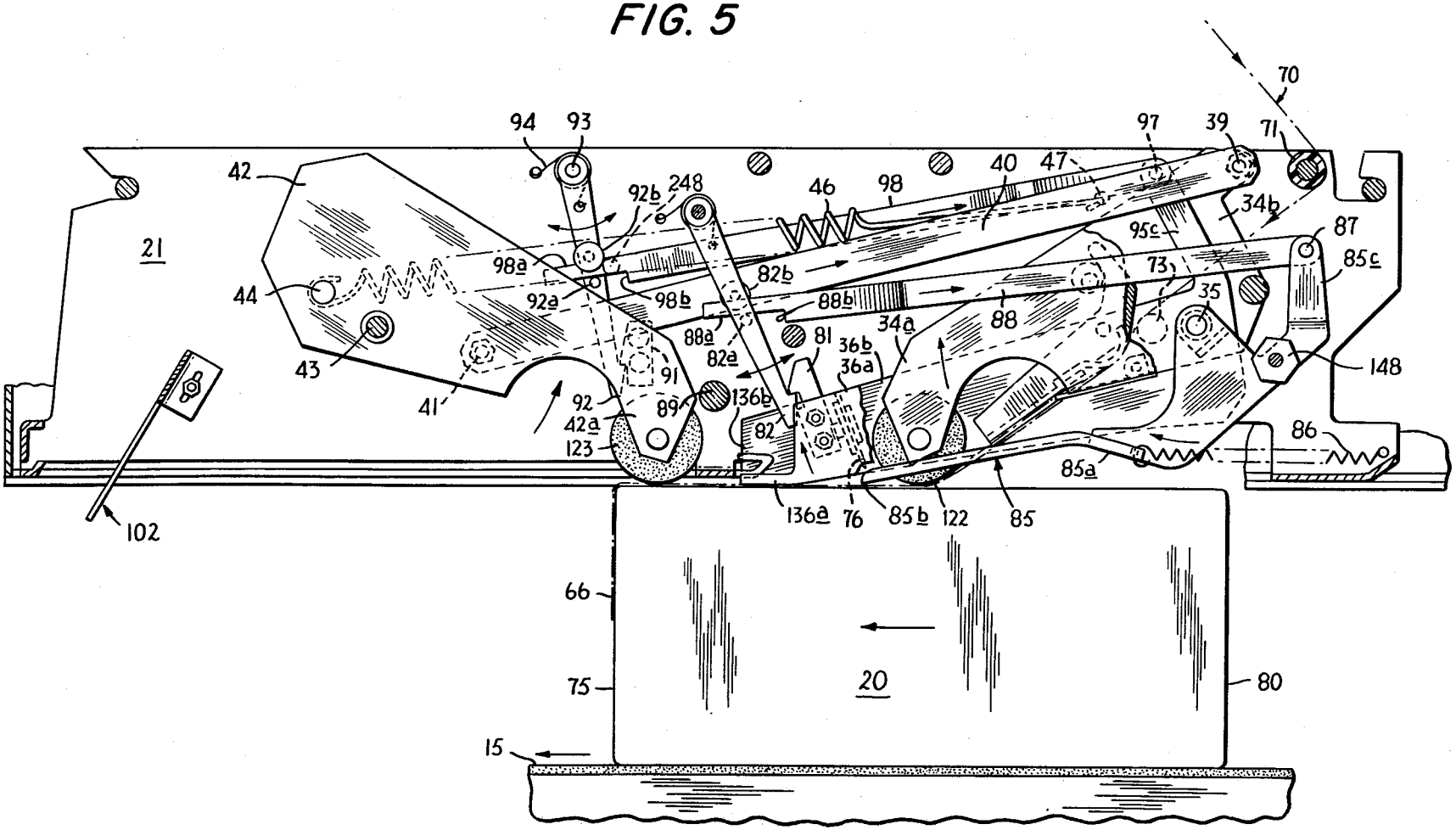
FIG. 5 is a sectional view similar to FIG. 2 with respect to the centrally located tape applying mechanism and the parts thereof, with parts broken away and in section, showing the advance of the loaded carton from the initial position in FIG. 1 to a forward position over the tape applying assembly.

In this rearward counterclockwise swing of the roller supporting arms 42*a* and 42*b* the latch hook 92 is urged by its biasing spring 94 to swing counterclockwise for engagement of the catch 91 that is fixed to the inner side of the roller supporting arm 42*b*, as will be seen in FIG. 5. This action was immdiately preceded by the latching of the other latch hook 82 with its catch 81 by virtue of the biasing action of the coil spring 84 that followed the counterclockwise raising of the oblique edges 136*a* and 136*b* as a result of drag along the inturned top side flaps of the carton in the vicinities of the upright sidewalls thereof.

Figure 2:
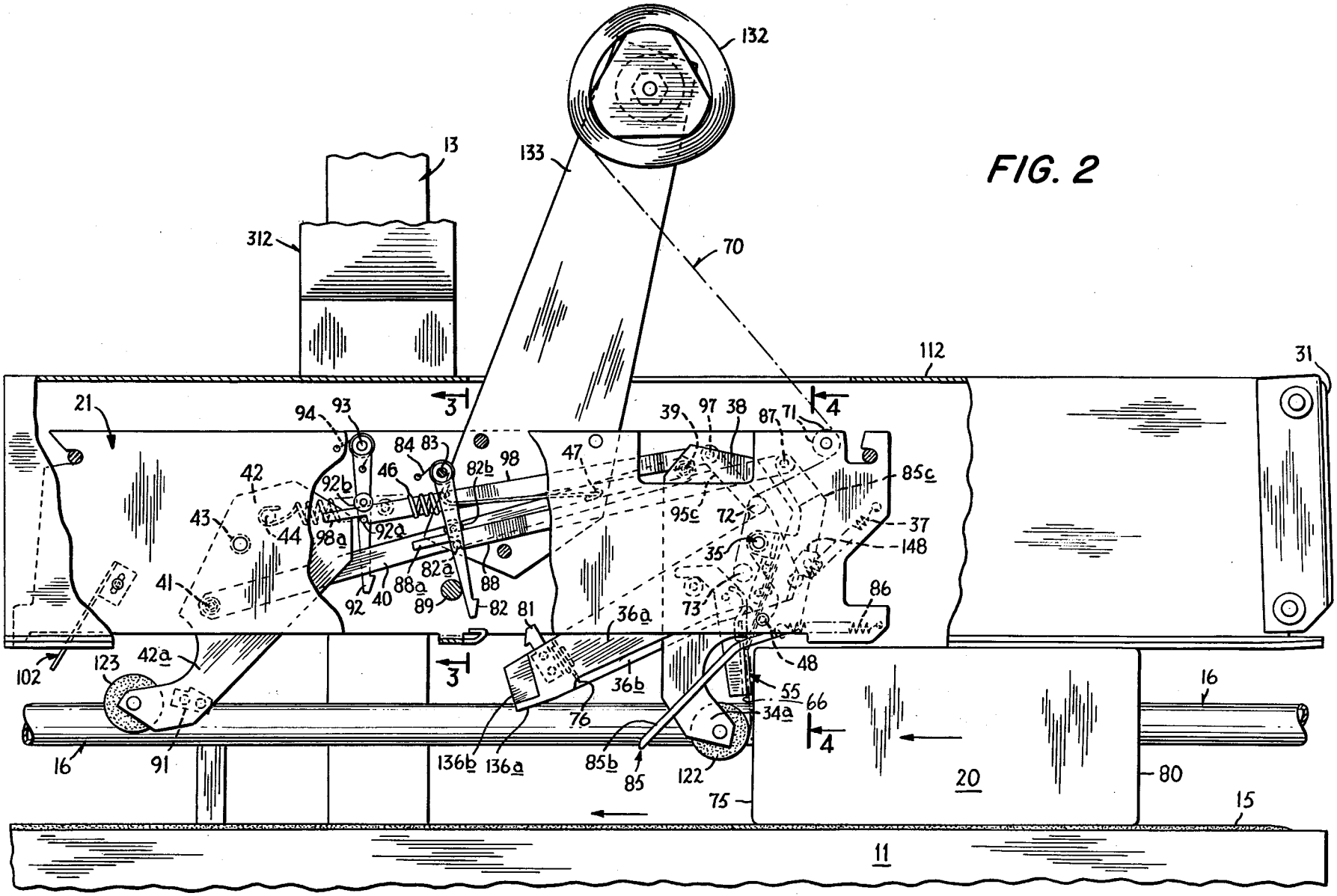
FIG. 2 is an elevational view, with parts broken away and in section, of the top portion of the base of such a machine and of the beam of the elevating head thereof in which is shown mounted a tape applicator assembly unit embodying features of the present invention.
Figure 3:
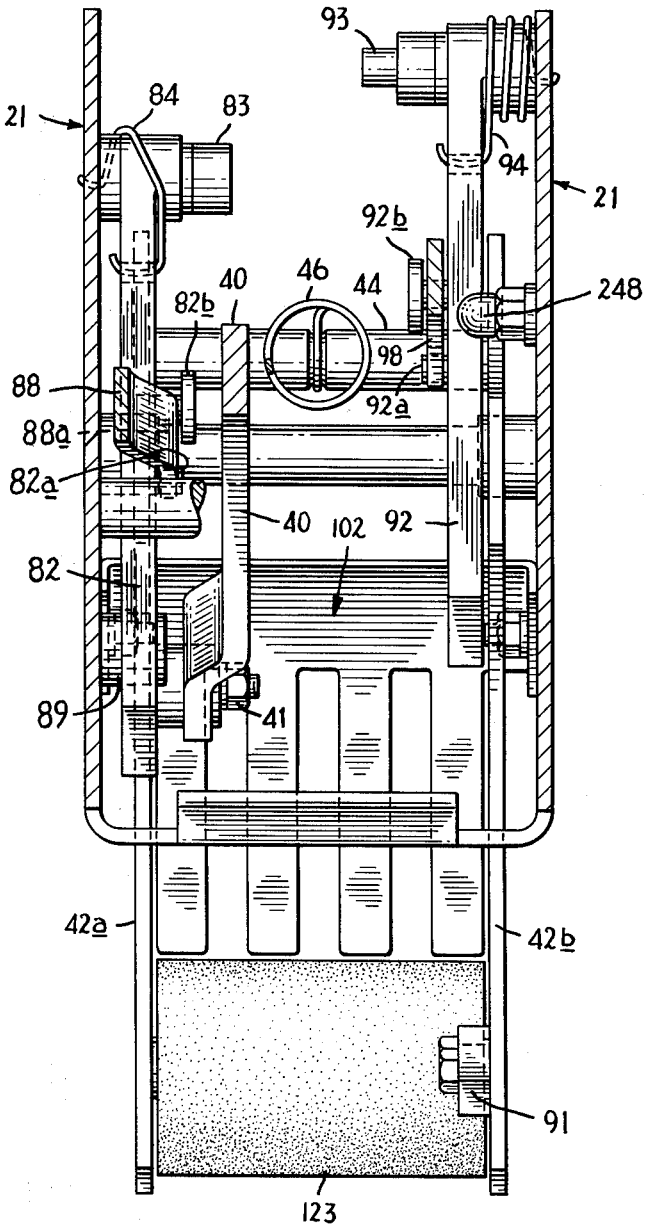
FIG. 3 is a sectional view to larger scale, with parts broken away, taken substantially on line 3—3 of FIG. 2.

As the carton 20 had advanced from its position of FIG. 2 forward toward its position in FIG. 5 the advancing top end section of the leading carton end wall 75 caused the roller 123 to first wipe the end of the adhering tape 66 up and over the top end corner and then back toward the rear wall as the carton progressively advanced. This caused the roller 122 to swing forward up partially past the trigger arm 85, so that the tape end of its extension 85*b* would be riding back along one of the infolded top side flaps adjacent its hinge line without imposing any undue pressure thereon due to substantially direct transmittal thereof down into the carton sidewall. This clockwise upward swinging of the trigger arm 85 against the biasing of its spring 86 caused its extension arm 85*c* to swing clockwise for applying pull to the push bar 88, for retracting its shoulder 88*b* away from the latch hook pin 82*a*.

As soon as the advancing carton 20 reached a forward position just immediately before that indicated in FIG. 6 the trigger arm 85 was released by its back end wall 80 passing therebeyond to permit its biasing spring 86 to swing it down counterclockwise to behind the advancing carton. However, the roller supporting arms 34*a* and 34*b* and its roller 122 remained in their same relative orientation because of the pull imposed at 39 by the link 40 due to the maintenance of the angular position of the supporting arms 42*a* and 42*b* with respect to the tape wiping roller 123 carried thereby, particularly since the support provided for the roller 123 at the plane of the stacked flaps closure along the top of the carton and the retained engagement of the latch hook 92 with its catch 91.

It will be seen from FIG. 7 that as soon as the oblique extensions 136*a* and 136*b* of the knife-carrying lever arms 36*a* and 36*b* were freed from riding contact with the top carton closure this knife-carrying lever arm assembly swung down counterclockwise to the position shown in FIG. 7. It is this downward swing which causes the knife 76 to engage the stretch of adhering tape extending from the carton top closure back beyond its trailing back wall 80 and sever it for providing a short end section for lap down against the carton back end wall 80. The roller 122 was maintained in its preceding level of elevation because of the action of the biasing spring 46 and the maintenance of the level of the contact point of the roller 123 along the plane of the carton top. It is this counterclockwise swing of the lever assembly 36*a* and 36*b* (which carries the knife 76) that transmitted thrust by the extension 85*c* and thrust bar 88 which then caused the disengagement of the latch hook 82 from its complementary catch 81, as is illustrated in FIG. 6, for allowing the downward swing of the knife-carrying arm assembly 36*a* and 36*b* to effect the tape severance. Such downward swing was limited or checked by engagement of the butt end of such knife-carrying arms assembly against the stop 148, as will be seen in both FIGS. 7 and 8. Such latch freeing thus permits the clockwise swinging of the roller-carrying arms assembly 42*a* and 42*b*, so that the second roller 123 thus rolls down the back end wall 80 as it is moving still further forward for wiping thereon the terminal tape end section 166. Thus the presence of the void 99 above the load 100 in the carton chamber, as is suggested in FIG. 7, does not hazard a downward warping of the carton top closure because of lack of support thereof as the tape wipe-on rollers 122 and 123, and the knife carrying arms assembly 36 were caused by weight and spring biasing to press downward on the carton top as it was moved forward during the tape draping thereof. This thus avoided a possibility of such a downward distortion of the top closure wall of the carton because of the lack of support in such head space void by the load that would permit either of such rollers to catch into the top marginal zone of the rear end wall 80 of the carton to tear it out as it passed, or collapse the entire carton top.

It will be noted that the tape applying assembly unit 21 is also equipped with a useful wipe-on brush 102 which drags along the taped top closure of the carton and gently press the applied tape down against the carton top flaps assembly.

It will be understood that since the trigger arm 85*b* is aligned with, to overlay the top edge of, the knife-carrying arm 36*a*, the depression of this trigger arm initially by engagement depresses this knife-carrying arm. Ultimately, the latching of the knife carrying arm 36*a* relieves the trigger arm 85 from a duty of holding it depressed or retracted while the carton top is sliding forward therebeneath. However, it is believed to be obvious, that this trigger arm may, if desired, be associated with suitable holding equipment that will perform this function while the carton advances therebelow.

While the drawings and description illustrate the mount of such a tape applying mechanism unit 21 within the head beam 112 it should be obvious that a similar such unit may be installed in the table therebelow for applying adhering tape to the bottom folded flaps closure.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described our invention, what we claim as new and desire to secure by Letters Patent is the novel subjects matter defined in the following claims.

We claim:

1. In a machine for sealing forwardly traveling rectangular cartons with adhering tape extending longitudinally from end to end and lapping folded stacked flaps as top and/or bottom closure means to prevent normally projecting tape applicator means from applying to such closure means of each carton excessive inward pressure which may cause such deflection thereof as to catch into and break back out an edge portion of the carton trailing back end wall; comprising 1. movably mounted tape applicator means projectable into a defined path of forward travel of a closure of folded and stacked flaps of an advancing carton and biased inward thereagainst normally for depression thereby as the carton travels forward for application of tape to such forwardly traveling closure;
2. mechanism alternately to project and retract said tape applicator means located initially in the path of forward travel of each such carton for retractive manipulation of said inwardly biased projecting applicator means upon contact by said advancing carton;
3. releasable latch means manipulated by said mechanism to hold said tape applicator means retracted to the vicinity of the margins of the forward travel path of such carton and its closures of folded flaps while said advancing carton and its closure are traveling past said tape applicator means; and
4. means to release said latch means for restoring the projection of said tape applicator means into the carton travel path after passage of said carton.

2. The tape applicator means and its manipulating mechanism as defined in claim 1 characterized by said tape applicator means being in the form of at least a pair of separate tape-applying first and second rollers each separately mounted by one of a pair of longitudinally-succeeding pivoted carriers for successive locations along and projectingly in the carton path of said rollers and their carriers and with each being associated with releasable latch means.

3. In a machine for sealing forwardly traveling cartons with adhering tape lapping folded stacked flaps as top and/or bottom closure means to prevent normally projecting tape applicator means from applying to such closure means of each carton excessive inward pressure which may cause such deflection thereof as to catch into and break back out an edge portion of the carton back end wall; comprising 1. movably mounted tape applicator means in the form of at least a pair of separate tape-applying first and second rollers separately mounted by one of a pair of longitudinally-succeeding pivoted carriers for successive locations along and projectingly in the forward travel path of such successive cartons and of their closures of folded and stacked flaps for depression by each such carton as it travels forward thereover for application of tape to such forwardly traveling closure thereof;
2. mechanism alternately to project and depress said tape applicator means located initially in the path of forward travel of each such carton for depressive manipulation of said projecting applicator means upon contact by said advancing carton;
3. releasable latch means in the form of at least two separate ones with each manipulated by carton depressible control means to hold said rollers and their carriers depressed while said advancing carton and its closure are traveling therepast; and
4. means to release said latch means for restoring the projection of said tape applicator means into the carton travel path after passage of said carton.

4. The tape applicator means and its manipulating mechanism as defined in claim 3 characterized by a pair of pivoted levers each serving as the carton-depressible control means for one of said latch means.

5. The tape applicator means and its manipulating mechanism as defined in claim 4 characterized by a movable trigger member biased projectingly into the path of an oncoming carton for depression to a retracted position and maintenance of its retraction by and during the passage of such carton, said trigger member being adapted in its retraction and during such retraction to depress and hold depressed the first and second roller carriers.

6. The tape applicator means and its manipulating mechanism as defined in claim 5 characterized by each of said two separate latch means including a catch and a movable, complementarily engagable latch hook, the first one of said catches being carried by the first of said levers with its complementary latch hook being manipulated by said trigger member for engagement with this catch.

7. The tape applicator means and its manipulating mechanism as defined in claim 6 characterized by the second of said catches being carried by said second roller carrier with its complementary latch hook being manipulated by said first lever.

8. The tape applicator means and its manipulating mechanism as defined in claim 7 characterised by said first lever also carrying a tape-severing knife to be swung across the stretch of tape extending from the first roller to the stacked flaps closure of the carton as it passes beyond this roller for freed swing thereof and of the knife carrying lever for tape cut-off.

9. The tape applicator means and its manipulating mechanism as defined in claim 7 characterized by said trigger member being connected by thrust means to the first latch hook to move the latter out of engagement with its catch on said first lever.

10. The tape applicator means and its manipulating mechanism as defined in claim 9 characterized by said first lever being connected by thrust means to the second latch hook to move the latter out of engagement with its catch on said second roller carrier.

11. The tape applicator means and its manipulating mechanism as defined in claim 10 characterized by said second roller carrier being connected to said first roller carrier by coupling rod means in a manner causing said second roller carrier to be swung back toward said first roller carrier as the latter is swung forward in the direction of forward travel of such carton.

* * * * *

UNITED STATES PATENT AND TRADEMARK OFFICE

CERTIFICATE OF CORRECTION

PATENT NO. : 4,061,526

DATED : December 6, 1977

INVENTOR(S) : Saul Warshaw, Winton Loveland, Horst J. Hanemann, and Michael Ramaglia It is certified that error appears in the above-identified patent and that said Letters Patent are hereby corrected as shown below:

Abstract lines 11 and 12 respectively, for "forwad" and "forwadly" read --forward-- and --forwardly--. Column 5, line 28, for "35a" read --36a--; and last line (68) for "81" read --82--. Column 7, line 9, for "immdiately" read --immediately--; and line 54, for "causes" read --caused--. Column 10, line 36 (Claim 8, line 2) for "characterised" read --characterized--.

Signed and Sealed this

Seventh Day of March 1978

[SEAL]

*Attest:*

RUTH C. MASON
*Attesting Officer*

LUTRELLE F. PARKER
*Acting Commissioner of Patents and Trademarks*